US005623808A

United States Patent [19]

Franklin et al.

[11] Patent Number: 5,623,808

[45] Date of Patent: Apr. 29, 1997

[54] APPARATUS AND METHOD FOR PALLETIZING AND WRAPPING A LOAD

[75] Inventors: Joseph F. Franklin; Owen N. Reese, II, both of Montgomery, Ala.

[73] Assignee: HK Systems, Inc., New Berlin, Wis.

[21] Appl. No.: 588,774

[22] Filed: Jan. 19, 1996

[51] Int. Cl.[6] ..... B65B 13/10; B65B 35/50; B65B 53/00

[52] U.S. Cl. ..... 53/399; 53/441; 53/447; 53/556; 53/588; 53/535

[58] Field of Search ..... 53/399, 441, 447, 53/556, 588, 535, 536, 540

[56] References Cited

U.S. PATENT DOCUMENTS

| | | | |
|---|---|---|---|
| 3,994,114 | 11/1976 | Nishimura . | |
| 4,060,957 | 12/1977 | Birkenfeld et al. . | |
| 4,109,445 | 8/1978 | Shulman . | |
| 4,232,501 | 11/1980 | Stackhouse . | |
| 4,439,084 | 3/1984 | Werkheiser | 53/535 X |
| 4,587,796 | 5/1986 | Haloila . | |
| 4,593,517 | 6/1986 | Mattila | 53/535 X |
| 4,936,080 | 6/1990 | Haloila . | |
| 4,993,209 | 2/1991 | Haloila . | |
| 5,203,671 | 4/1993 | Cawley et al. | 53/588 X |
| 5,390,476 | 2/1995 | Morantz . | |

FOREIGN PATENT DOCUMENTS

| | | | |
|---|---|---|---|
| 561098 | 9/1993 | European Pat. Off. | 53/441 |

OTHER PUBLICATIONS

Brochure entitled Lantech, Inc. Ring Straddle System, Lan–wrapper.

*Primary Examiner*—Linda Johnson
*Attorney, Agent, or Firm*—Nilles & Nilles, S.C.

[57] ABSTRACT

An apparatus for packaging and wrapping a load, and a method for using the same, having an infeed conveyor for receiving bundles from an assembly or production line, positioning conveyors located downstream of the infeed conveyor for arranging the bundles into load layers, and stripper plates downstream of the positioning conveyor for receiving and discharging the load layers. A pair of lifts are located below the stripper plates for raising and lowering a pallet. The second lift is mounted on the first lift, so that the two lifts combine to raise a pallet to receive successive load layers from the stripper plates. A wrap ring including a film dispenser is mounted below the stripper plates, so that the dispenser may orbit and dispense a plastic film material about the load. The second lift raises the pallet above the first lift to position the load adjacent the dispenser for wrapping. Guide plates are mounted above the wrap ring to stabilize the load prior to wrapping.

19 Claims, 7 Drawing Sheets

APPARATUS AND METHOD FOR PALLETIZING AND WRAPPING A LOAD

TECHNICAL FIELD

The present invention relates to an apparatus and method for palletizing and wrapping a load, and more particularly, to an apparatus and method for arranging products into layers, stacking the layers on a pallet, and wrapping the layers in a plastic film material all within a single apparatus, in order to simplify the packaging process and increase the stability of the load.

BAGKGROUND OF THE INVENTION

In production and assembly facilities, one of the most common forms of packaging and transporting finished product is by stacking the products into bundles or cases, and loading the bundles onto pallets. In these facilities, a palletizing machine is often used to take the finished product from the assembly or production line and load it onto pallets. As the products are conveyed into the palletizer, the palletizer arranges them into layers. These layers may each have the same pattern such that the products will be arranged in vertical stacks on the pallet, or the layers may be arranged in different patterns, so that the stacked products will form interlocking layers on the pallet. After a layer has been formed, it is loaded onto a pallet by conveying the layer onto a pair of stripper plates, and then separating the plates, so that the layer is dropped onto a pallet which has been lifted by a hoist into position beneath the plates. While a layer is being released, the palletizer is simultaneously forming the next layer on the conveyor. The palletizer continues in this method, forming and releasing layers, until the entire load has been stacked on the pallet.

After the bundles have been loaded onto a pallet, they are typically wrapped in a plastic film material in order to prevent shifting or tipping during transit. Heretofore, several methods have been employed to wrap the load. In the first method, the pallet with its load stacked thereon is transported from the palletizer to a rotatable base by a forklift truck or along a conveyor. Once on the base, the load is wrapped by rotating the base while a plastic film material is payed out from a stationary roll adjacent the base. In a second method, the pallet and stacked load are conveyed to a stretch wrap machine. In the machine, the pallet and load are maintained in a stationary position while a centrally-located, rotating arm carrying a roll of plastic film orbits about the load paying out plastic film material onto the load as it rotates. In a third method, the load is transported to a stretch wrap machine having a ring member and attached plastic film dispenser, which rotates around the load paying out film material as it goes. While these methods each have different ways of dispensing wrap, they have in common the drawback that the palletized load must be transported or conveyed to a separate machine before it is wrapped.

While transporting an unwrapped load a short distance is typically not a problem for products which have a standard shape or are packaged in boxes or cases, it can cause shifting or tipping in more unstable loads, such as newspapers. In a load of newspapers, the papers are typically folded and tied together in bundles with a center belt, such that the bulk of the paper squeezes out on both sides of the belt. This bundling method, and the common practice of placing inserts and other non-standard size material within the newspapers, results in paper bundles which are different sizes and shapes. When the paper bundles are stacked onto pallets for shipping, the variation in sizes between the bundles causes the palletized load to be very unstable. Thus, any transporting of the load without a stabilizing stretch wrap, even just conveying the load to a stretch wrap machine, will result in shifting and tipping within the load.

While it has long been desirable to have a combination palletizer and stretch wrap apparatus to deal with the problem of unstable loads, solutions have been elusive due to spacing and structural problems associated with combining a stretch wrap apparatus with the hoist in a palletizer. Stretch wrap machines that rely on a central arm to orbit the load and dispense wrap are impractical because the central arm interferes with the loading of the products onto the pallet, as well as the raising and lowering of the hoist. Likewise, wrap mechanisms that rely on a ring member to rotate about the load have not been combinable with a palletizer, because the side posts of the palletizer hoist fall between the wrap ring and the load, and thus interfere with wrapping the load. While the hoist could be expanded so that the wrap ring fit inside of it, this would require expensive, specially designed hoists and significantly increase the floor space required by the palletizer. A packaging machine has been proposed which employs a standard sized hoist with a wrap ring that has been reduced in size to fit within the hoist. While this machine eliminates the need for excessive floor space, its usefulness is limited since only small, non-industry standard pallets can be used with the smaller wrap ring.

Thus, a need exists for an apparatus and method for wrapping an unstable load within a palletizer, as the load is formed, in order to eliminate the need to transport the load to a separate stretch wrapping machine. Further, it is desirable to have such a method and apparatus which can be used with industry-standard sized pallets, and which requires a minimum amount of floor space.

SUMMARY OF THE INVENTION

Accordingly, it is a principal object of the present invention to provide a method for securely palletizing a number of irregular or unstable products, and an apparatus for applying the same.

In particular, it is an object of the present invention to provide a combination palletizer and stretch wrap apparatus which eliminates the need to convey loads between separate machines during packaging operations.

It is another object of the present invention to provide a combination palletizer and stretch wrap machine which can be used with industry-standard sized pallets.

Yet another object of the present invention is to provide a combination palletizer and stretch wrap machine which stabilizes insecure loads prior to wrapping to produce a sturdier load.

Yet another object of the present invention is to provide a combination palletizer and stretch wrap machine which decreases the time required to wrap a load as compared to more conventional methods.

Still another object of the present invention is to provide a method for wrapping a load as it is formed on a pallet.

Additional objects, advantages and other novel features of the invention will be set forth in part in the description that follows and, in part, will become apparent to those skilled in the art upon examination of the invention. The objects and advantages of the invention may be realized and obtained by means of the instrumentalities and combinations particularly pointed out in the appended claims.

To achieve the foregoing and other objects, and in accordance with the purposes of the present invention as described above, an apparatus for palletizing and wrapping a load, and a method for using the same, is provided comprising an infeed conveyor for receiving bundles form an assembly or production line, positioning conveyors located downstream of the infeed conveyor for arranging the bundles into load layers, and stripper plates downstream of the positioning conveyor for receiving and discharging the load layers. A pair of lifts are located below the stripper plates for raising and lowering a pallet. The second lift is mounted on the first lift, so that the two lifts combine to raise a pallet to receive successive load layers from the stripper plates. A wrap ring including a film dispenser is mounted below the stripper plates, so that the dispenser may orbit and dispense a plastic film material about the load. The second lift raises the pallet above the first lift to position the load adjacent the dispenser for wrapping. Guide plates are mounted above the wrap ring to stabilize the load prior to wrapping.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different, obvious aspects all without departing from the invention. Accordingly, the drawings and description should be regarded as illustrative in nature and not as restrictive.

DETAILED DESCRIPTION OF THE PREFERRED EMBODIMENT

Figure 1:
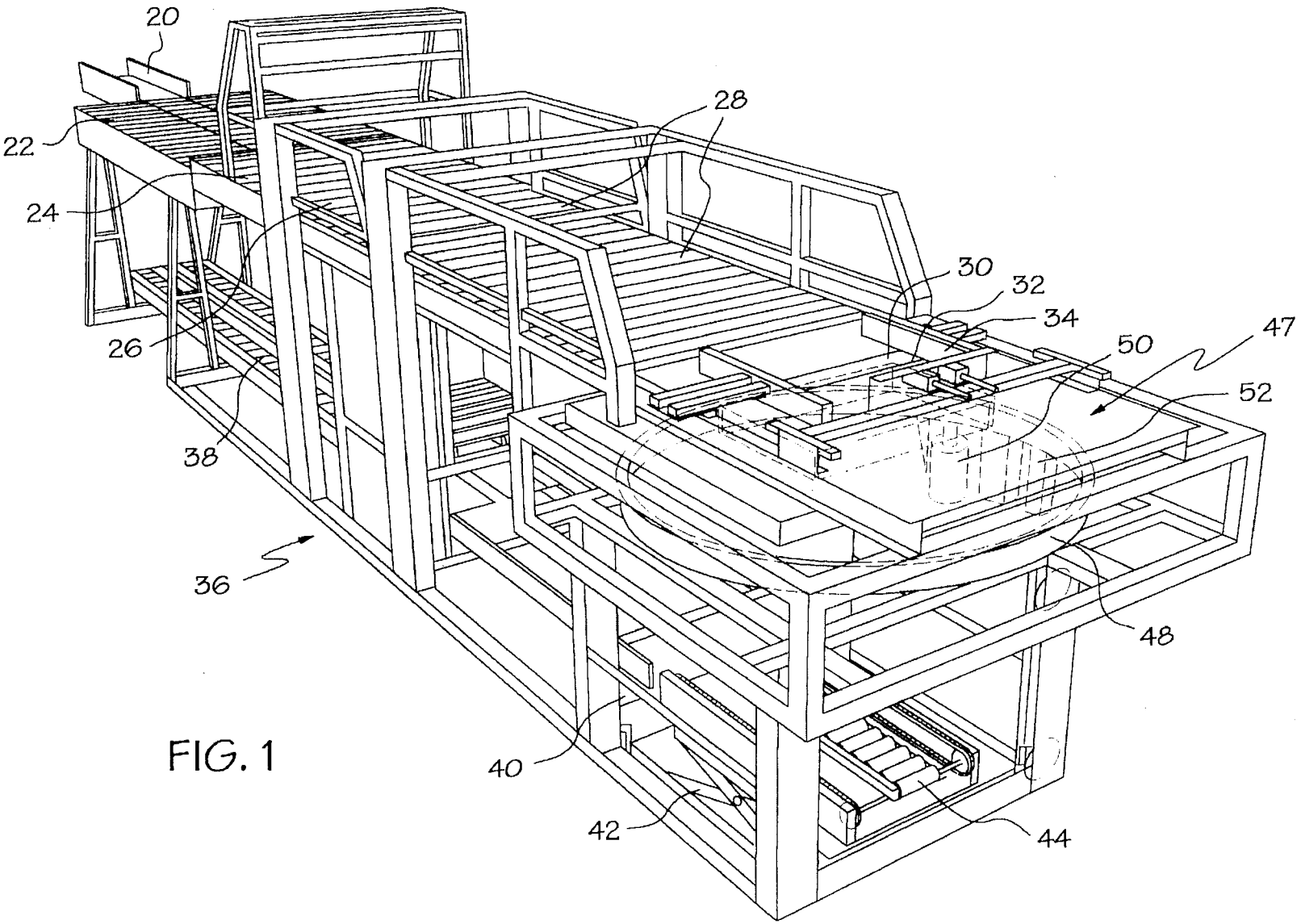
FIG. 1 is a perspective view of the stretch wrap palletizer apparatus of the present invention.
Figure 2:
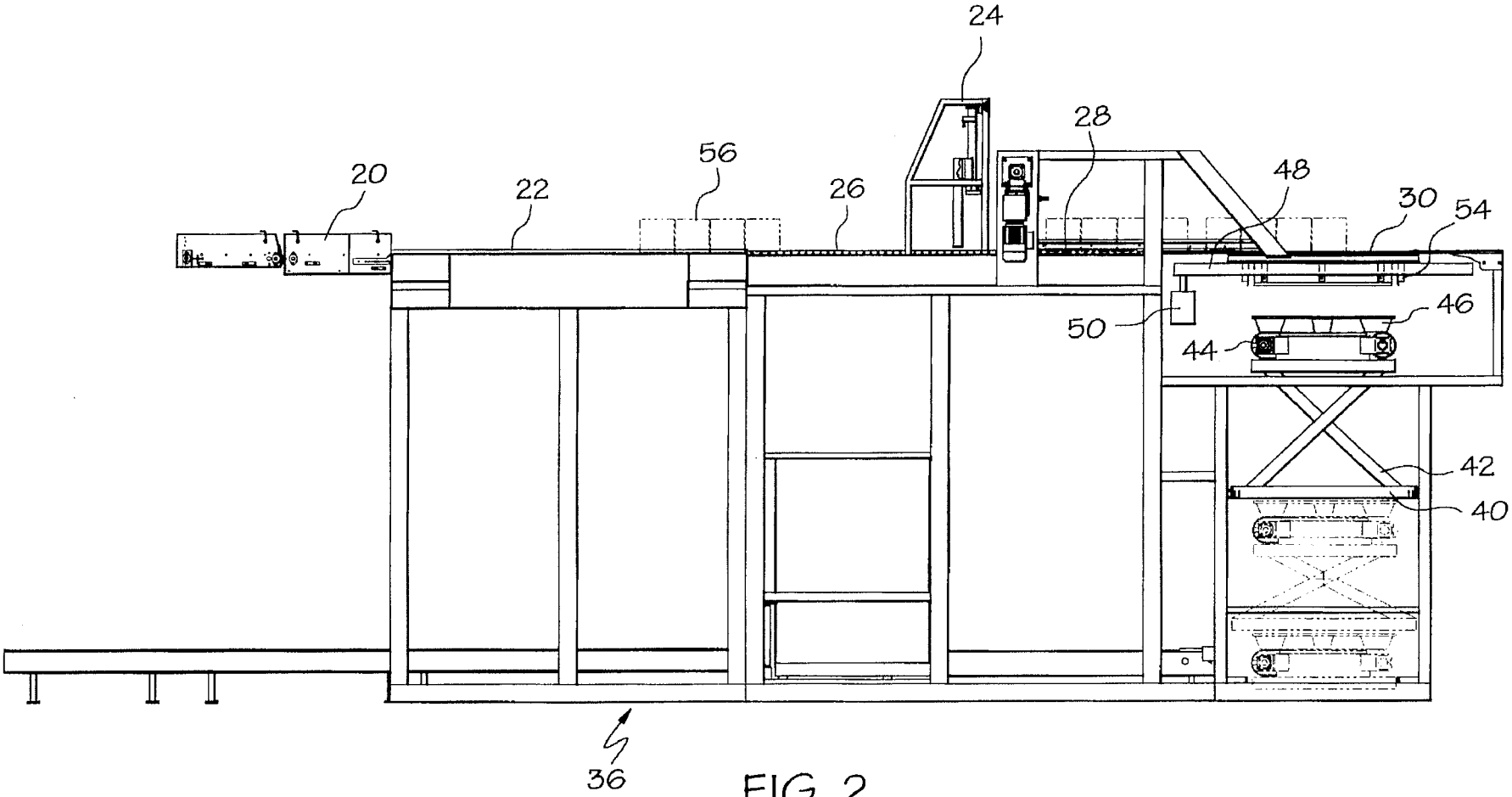
FIG. 2 is a front view, partially in section, of the stretch wrap palletizer apparatus of FIG. 1, illustrating the scissor lift and chain hoist in multiple positions.
Figure 3:
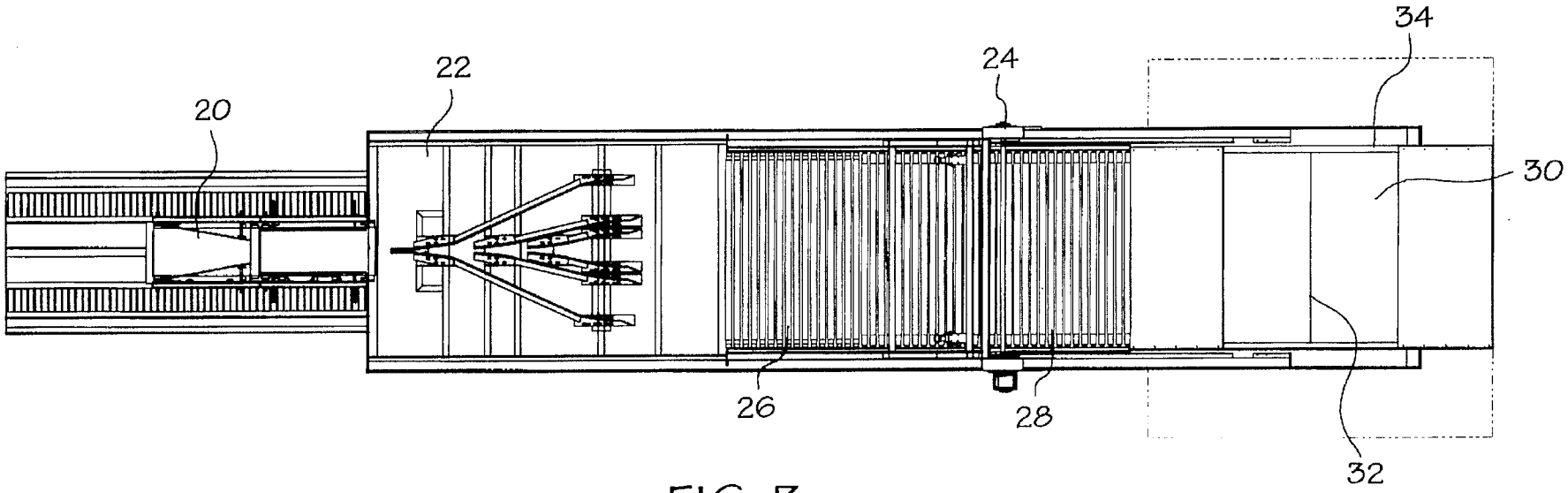
FIG. 3 is a top view of the stretch wrap palletizer apparatus of FIG. 1.

Referring now to the drawings, FIG. 1 illustrates a conventional palletizer machine modified to include stretch wrap capabilities according to the present invention. As shown in FIG. 1, the palletizer includes a belt infeed conveyor 20 at the front end of the machine. The infeed conveyor 20 may be connected to the end of a production or assembly line, such as a printing press line, to receive units of finished product or bundles and convey them into the palletizer. Down line from the infeed conveyor 20 is a slat sorter 22. The slat sorter 22 takes the bundles fed in by the conveyor 20 and directs them into a number of different lanes on the palletizer conveyor depending upon the particular pattern that is to be formed for the layer. In addition to the slat sorter 22, the palletizer may include a turning section 24 which can be used to orient the bundles into a number of different positions, depending upon the layer, in order to form various patterns. As shown in FIGS. 1–3, the palletizer also contains a belt-driven roller conveyor 26 for conveying the bundles through the palletizer. The slat sorter 22 and turning section 24 orient the bundles into the proper direction on the roller conveyor 26. Downstream of the sorter 22 and turning section 24 are one or more accumulating conveyors 28 where the sorted bundles are collected to form layers, and the layers staged prior to being deposited onto a pallet. Adjacent to the accumulating conveyors is a set of biparting stripper plates 30 through which the layers are discharged onto a pallet. The biparting stripper plates 30 are centered over the main hoist and are designed to separate along a center line 32 in a known manner to deposit a layer onto a pallet below. Floating rake bars (not shown) may also be provided between the accumulating conveyors 28 and the stripper plates 30 for transferring the accumulated layers onto the stripper plates. In addition, compression bars 34 may be located around the edges of the stripper plates 30 to push the layer into the proper shape before it is dropped through the plates.

As shown in FIGS. 1 and 2, a pallet staging area 36 is located beneath the belt infeed, sorter and accumulating conveyors. This staging area 36 may be comprised of a belt driven conveyor for staging multiple pallets within the palletizer. As an alternative, the palletizer may include a single pallet staging area, in which case only one pallet is staged at a time, and each time a pallet is loaded, a new pallet is placed into the staging area. In the palletizer depicted in the drawings, either single or multiple pallet staging can be used. In the case of multiple pallet staging, up to 5 stacks of empty pallets can be staged for use. The pallet staging area 36 includes belt-driven accumulation rollers 38 which transfer the empty pallets from the staging area 36 to a main hoist 40. The main hoist 40 is located at the end of the pallet staging area 36 and directly below the bi-parting stripper plates 30. The hoist 40 raises the pallets to the stripper plates to receive load layers. In the illustrated embodiment, the hoist 40 is a conventional four point, chain-over-sprocket, electrically-driven, dual speed hoist.

The palletizer as described thus far is conventional in nature and, therefore, further description of the aforementioned aspects of the palletizer is not deemed to be necessary. The following description is directed to the elements added to the palletizer in accordance with the present invention. Initially, as shown in FIGS. 1 and 2, in the present invention a scissor lift 42 is added to the main hoist 40. The scissor lift 42 may be of conventional design, and in the preferred embodiment is operated by a self-contained contained hydraulic pump which powers a ram or cylinder to lower or raise the lift. The scissor lift 42 is mounted on the main, chain-driven hoist 40, in a piggy-back fashion, so that the scissor lift is raised when the main hoist is raised. A pallet platform, including a pallet conveyor mechanism 44 such as a roller bed or a drive chain or the like for moving pallets in and out of the hoist 40, is positioned above the scissor lift 42. As shown in FIG. 2, the scissor lift 42 and hoist 40 combine to lift the pallet conveyor mechanism 44 and pallet 46 to the stripper plates 30. Accordingly, a pallet can be raised and lowered at the combined speed of both the chain and scissor hoists, thereby increasing the speed of the palletizer without increasing the speed of the main chain hoist.

In addition to the scissor lift, the palletizer of the present invention has also been modified to incorporate a wrapping apparatus, designated generally as 47. The wrapping apparatus 47 includes a known rotatable ring member 48. The ring member 48 is supported on the palletizer frame by a known mechanism that enables the ring to rotate relative to the frame. The ring member 48 is mounted on the frame so as to be centered about and spaced beneath the stripper plates 30, but above the hoist 40 and scissor lift 42. The ring member 48 includes a film dispenser 50 which preferably contains a plastic film or stretch wrap material. The film dispenser 50 rotates along with the ring member 48 so as to orbit about a palleted load located within the ring. The ring member 48 may also include known mechanisms, depicted as 52, for cutting and sealing the plastic film material after it has been payed out about the load.

In addition to the scissor lift and wrap apparatus, a plurality of guide plates 54 are added to the palletizer of the present invention. As shown in FIG. 2, the guide plates 54 are mounted to the underside of the stripper plate frame, so as to surround the opening created by the stripper plates 30. After the stripper plates open and a layer is dropped therethrough, the layer passes through the plates 54. Passing the layer through the plates 54 helps to stabilize the dropping layer as it is deposited on the pallet to prevent tipping and shifting. In a preferred embodiment, the guide plates are made of transparent plastic to enable viewing of the loaded bundles through the plates.

Figure 11:
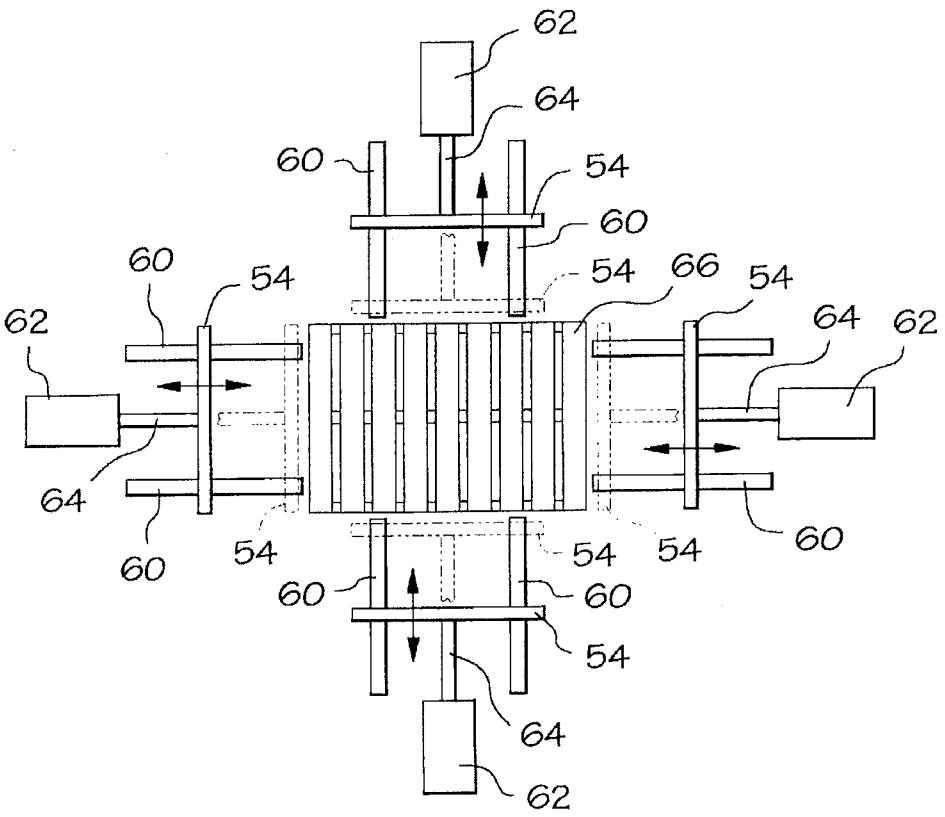
FIG. 11 is a top view of the guide plates and pneumatic drive cylinder.

As shown in FIG. 11, the guide plates 54 are mounted on rails 60 and may be reciprocated horizontally by means of pneumatic drive cylinders 62 which are coupled to the plates by connecting rods 64. The guide plates may be retracted to the position shown when an empty pallet 66 is initially raised into a layer-receiving position below the stripper plates 30. The guide plates may then be advanced to the position shown in phantom in order to center the pallet prior to receiving a layer. Reciprocating the guide plates to the retracted position ensures that a misaligned or skewed empty pallet does not jam against the bottom of the guide plates as the pallet is raised into a layer-receiving position.

Referring now to FIGS. 4–10, which illustrate a representative sequence for stacking and wrapping a load with the apparatus of the present invention. In this representative sequence, a load having four layers will be stacked and wrapped. However, it is to be understood that the present invention is applicable to loads having any number of layers, and of any height per layer, without departing from the scope of the invention. As described above, bundles 56 are conveyed into the palletizer through the belt infeed, and are individually sorted and turned to form the desired layer pattern. The desired layer pattern, as well as the number of layers in a load and the load height, are preprogrammed into the palletizer in a known manner, prior to initiating the job. The layers are assembled on the accumulator conveyor and held momentarily on the accumulating conveyor until the biparting stripper plates are vacant. Once the previous layer has been released through the stripper plates, and the plates closed, the layer is transferred to the stripper plates by the floating rake bars.

Figure 4:
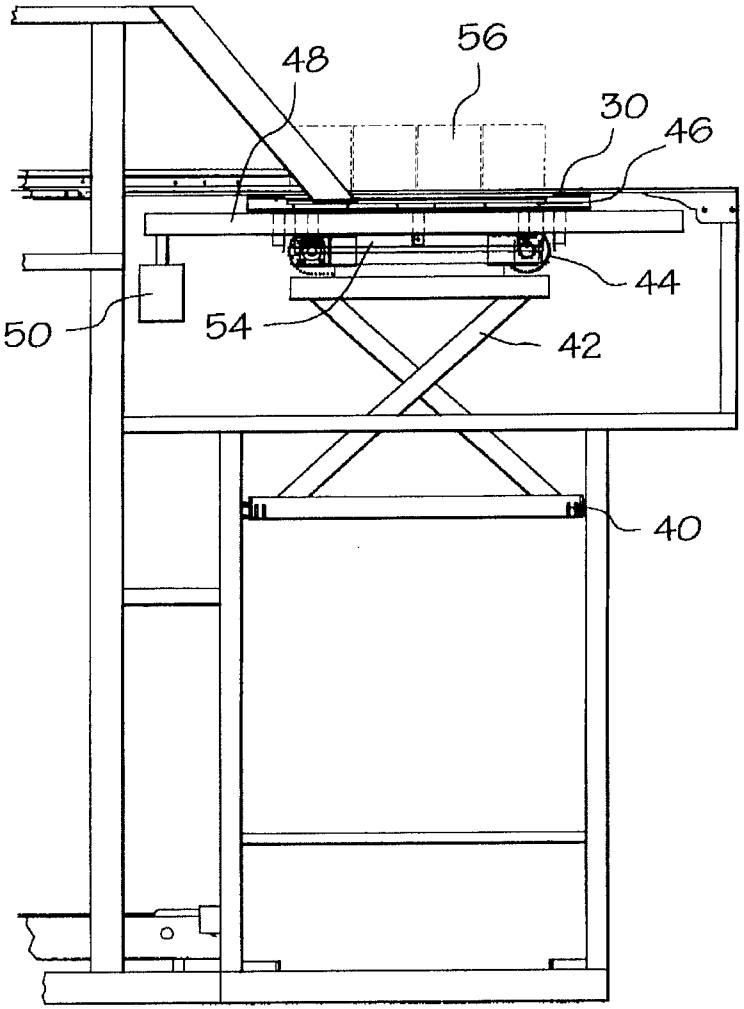
FIG. 4 is a partial, sectional view of the apparatus of FIG. 1, illustrating the hoists in a fully upright position.

While this first layer is being formed and staged, an empty pallet is transferred from the pallet staging area to the pallet conveyor on the scissor lift. Once on the lift, the pallet and pallet conveyor are raised within the main hoist area by the combined action of the chain and scissor hoists. The pallet and pallet conveyor are lifted through the hoist elevator by the action of both hoists, and through the stretch wrap ring by the scissor hoist alone. Once the pallet is in position beneath the stripper plates, the guide plates advance to center the pallet, and as shown in FIG. 4, the plates open and the first layer is dropped through the opening. From the stripper plates, the layer passes into the guide plates 54 surrounding the opening. These guide plates hold the layer together and prevent tipping and shifting.

Figure 5:
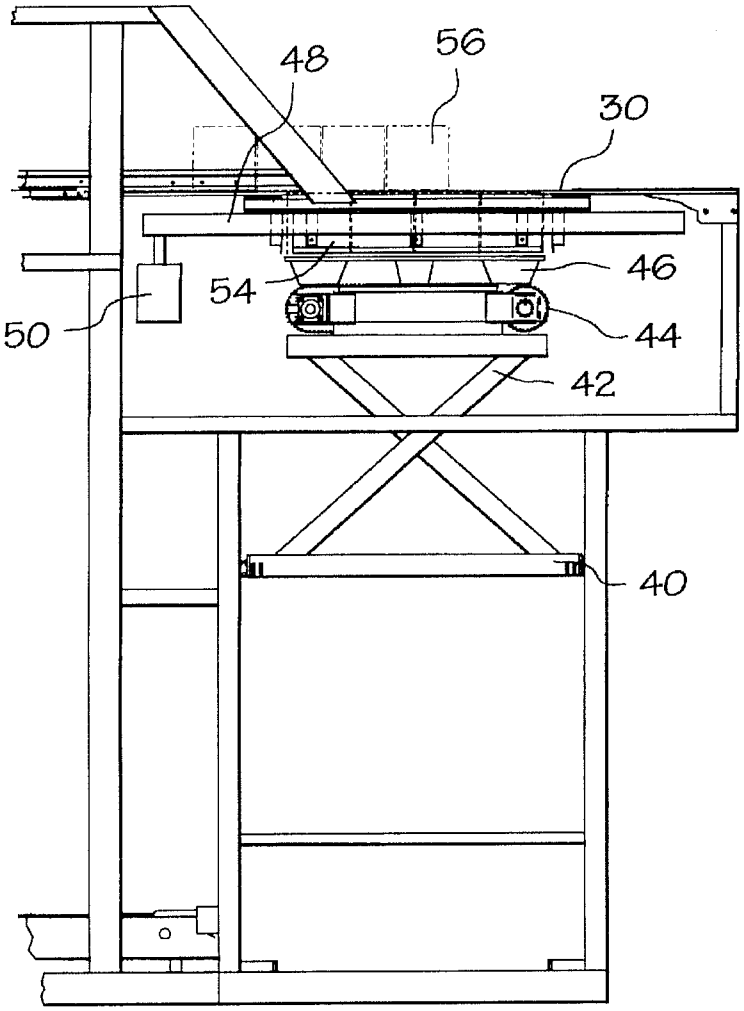
FIG. 5 is a partial, sectional view of the apparatus of FIG. 1, illustrating the first layer on the hoists and a second layer moving onto the stripper plates.

After the first load layer is deposited on the pallet, as shown in FIG. 5, the pallet is lowered by the scissor lift a sufficient distance to allow the stripper plates to close without interference from the load. The guide plates hold the layer steady while the pallet is lowered. After the plates are closed, the scissor lift again raises the pallet and first layer so that the layer is again immediately below the stripper plates. While the pallet and first layer are being raised, the second layer is transferred to the stripper plates. Once the pallet and first layer are in position below the stripper plates, the plates open and the second layer is deposited on the first. Again, the second layer passes into the guide plates as it is dropped onto the pallet. The pallet containing the first and second layers is then lowered to allow the stripper plates to again close without interference. Depending upon the height of the layers, one or more layers may be within the guide plates at the same time. As more layers are stacked onto the pallet the scissor lift is moved downward, so that eventually the pallet and layers emerge from the guide plates.

Figure 6:
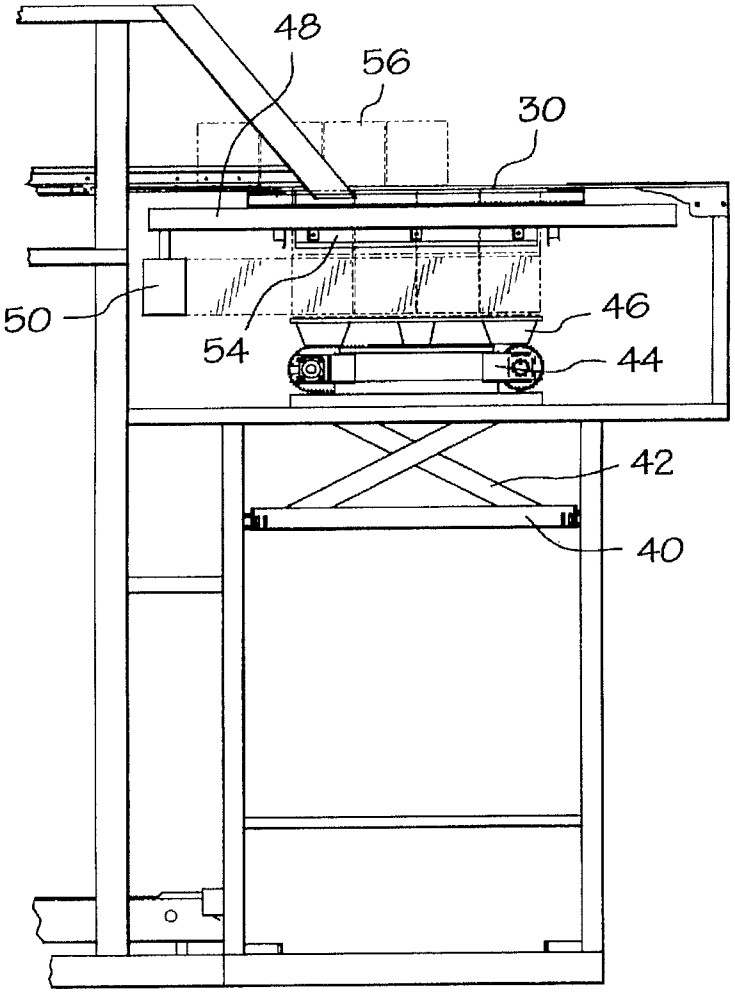
FIG. 6 is a partial sectional view of the apparatus of FIG. 1, illustrating two layers on the hoists and a third layer moving onto the stripper plates, and the first layer on the hoist being wrapped.

In the load depicted in the drawings, each layer is equal to the guide plates in height, such that only one layer is within the plates at a time. Thus, as shown in FIG. 6, once the second layer is stacked on the pallet, the first layer emerges from the guide plates. In the present invention, the wrap ring is mounted so that the dispenser is located just below the guide plates. The distance between the guide plates and ring is preferably about 2–3 inches. Therefore, once a layer has been lowered completely through the plates, it is adjacent the dispenser and can be wrapped. In the present invention, wrapping is not started on a layer until the layer is completely free of the guide plates. The palletizer of the present invention can be preprogrammed regarding the number of layers to be stacked on the pallet before wrapping begins. The number of layers to be stacked before wrapping will be dependent upon the number of layers, and the height of the layers and the guide plates.

Figure 7:
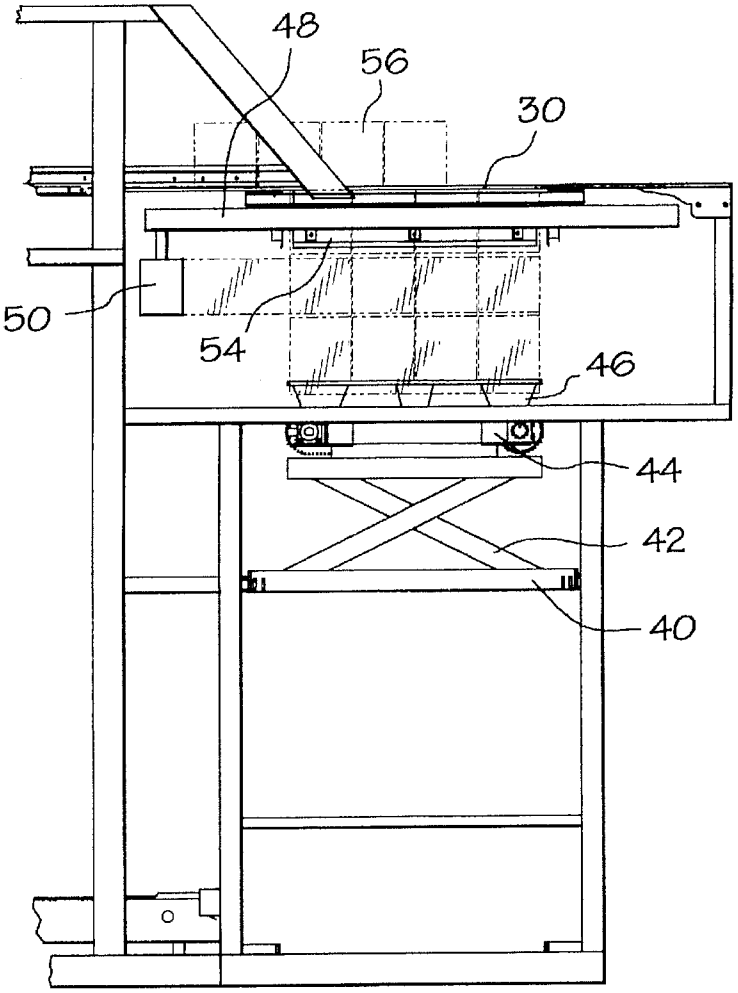
FIG. 7 is a partial sectional view of the apparatus of FIG. 1, illustrating three layers on the hoists and the layers and hoists raised to receive a fourth layer located on the stripper plates, the second layer being wrapped.
Figure 9:
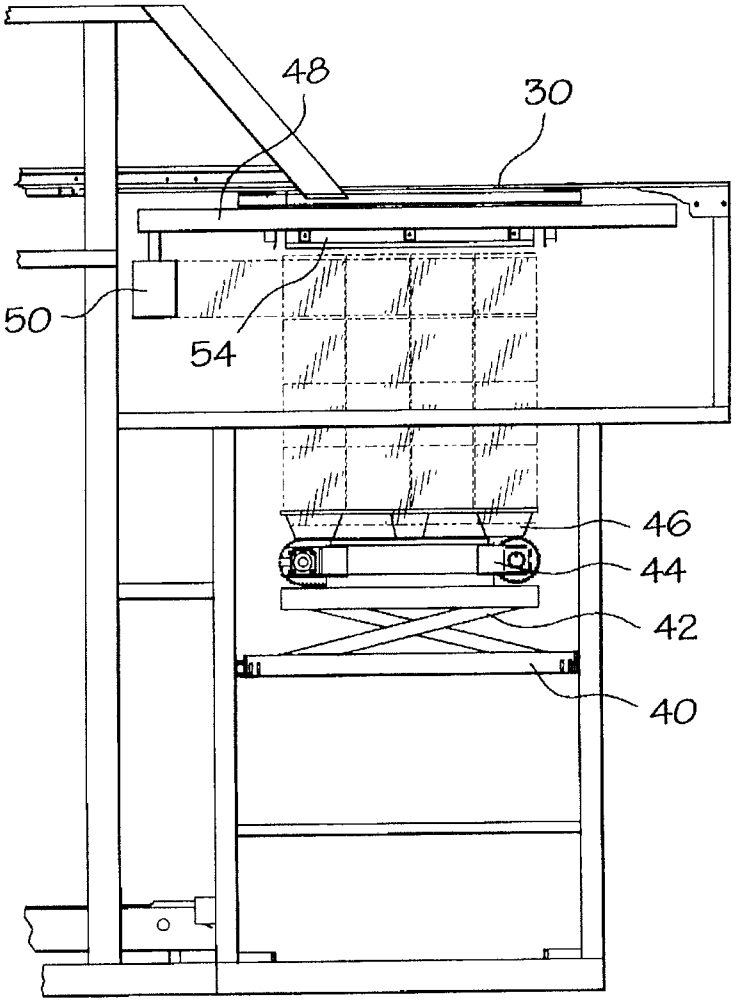
FIG. 9 is a partial sectional view of the apparatus of FIG. 1 illustrating the hoist with four layers, the hoists being lowered so that the fourth and top layer is being wrapped.
Figure 8:
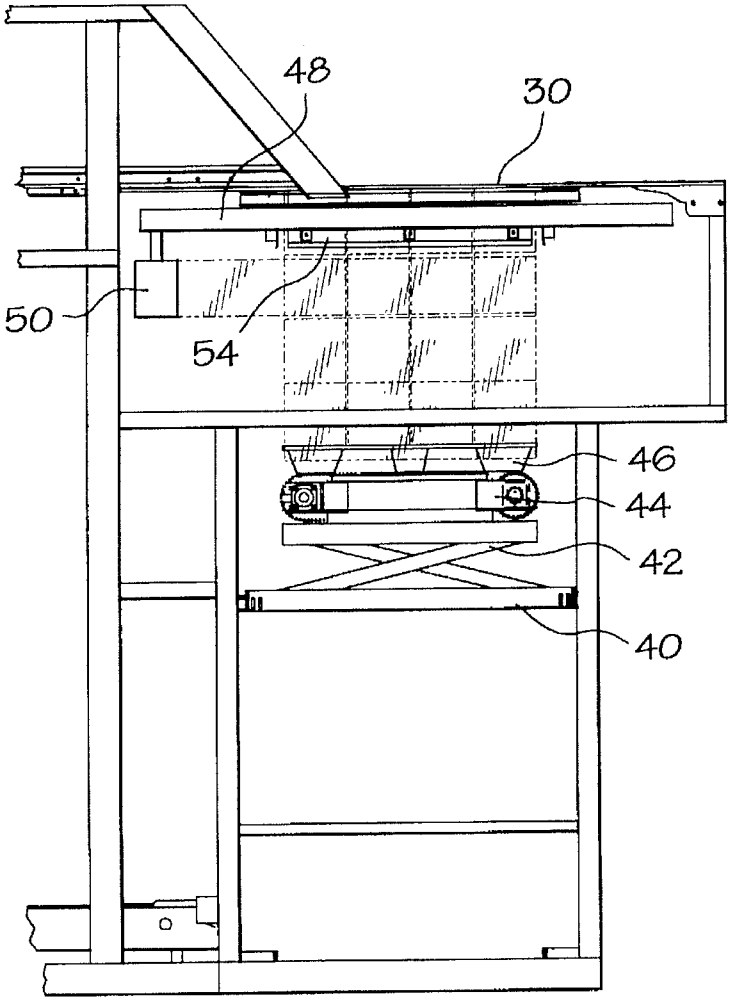
FIG. 8 is a partial sectional view of the apparatus of FIG. 1, illustrating the hoist with four layers and the third layer being wrapped.
Figure 10:
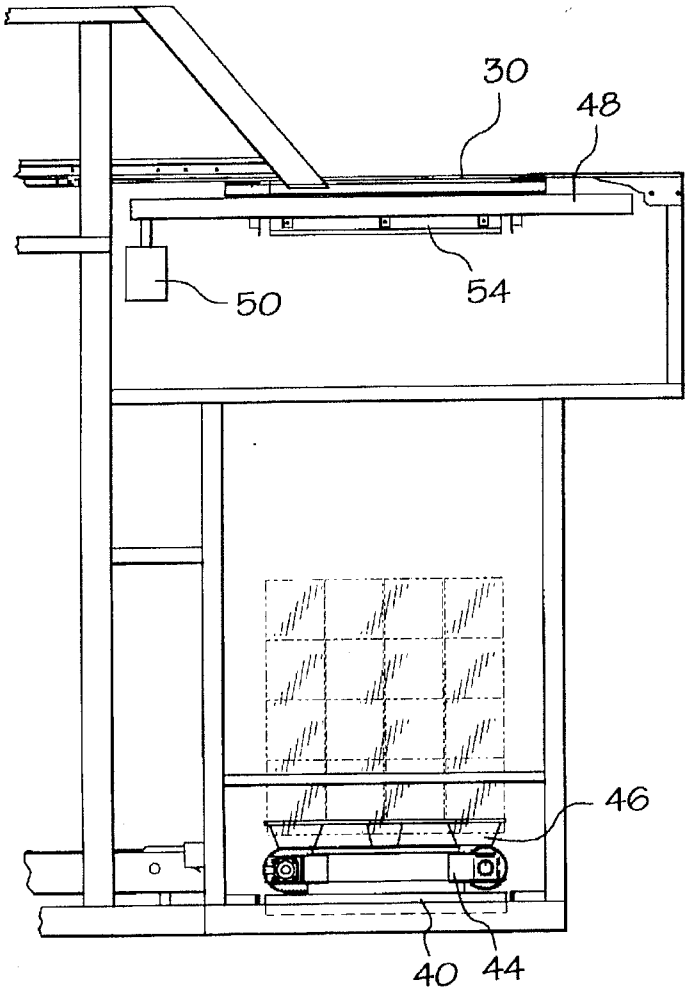
FIG. 10 is a partial sectional view of the apparatus of FIG. 1 illustrating the hoist and four layers lowered to the bottom of the hoist shaft.

As shown in FIG. 6, at this stage of the sequence the first layer is below the guide plates and being wrapped by the dispenser, the second layer is within the guide plates, and the hoists are raised to receive the third layer which is being staged on the stripper plates. The pallet is partially wrapped along with the first layer to secure the layer to the pallet. As the stripper plates open for the third layer, the lifts lower so that the third layer drops onto the pallet and within the guide plates. As shown in FIG. 7, as the lifts lower, the second layer exits the guide plates and wrapping begins on that layer. The wrap is applied to the second and additional layers so that it partially overlaps the preceding layer so that a continuous wrap is formed about the load. As the second layer is wrapped, the next, and fourth layer is moved onto the stripper plates. Once again the stripper plates are opened, and the lifts lowered with the fourth layer on the pallet. As the lifts lower, the third layer exits the guide plates and is wrapped as shown in FIG. 8. Since the load in the described, representative sequence contains four layers, after the fourth layer is stacked on the pallet, the lifts slowly lower the pallet away from the stripper plates as shown in FIG. 9. As the pallet is lowered, the fourth and final layer exits the guide plates and is wrapped. In addition, wrap is partially applied to the top of the load as the uppermost layer descends through the ring member. Once the topmost layer has been wrapped, the pallet and load are lowered to the bottom by both hoists, as shown in FIG. 10. By using both hoists to lower the load, the present invention further increases the speed of the palletizer over more conventional machines.

In conclusion, the present invention provides a combination palletizer and stretch wrap machine which combines a conventional palletizer with a stretch wrap ring in a novel manner to enable loads to be formed and wrapped simultaneously on standard 40×48" pallets. The present invention achieves this end by mounting a stretch wrap ring between the hoist and stripper plates in the palletizer, and providing a scissor lift on the hoist to lift the pallet and supporting platform above the hoist. The scissor lift enables the pallet to be lifted through the stretch wrap ring to receive load layers and then lowered through the center of the stretch wrap ring for wrapping. Because a scissor lift, having a smaller dimension than the chain hoist, is used to lift the pallet and load layers above the hoist and into the wrap ring there is no need to increase the size of the hoist and the hoist chains do not pass through the ring or interfere with the wrapping operation. Accordingly, a conventional sized hoist can be used in the present invention. Likewise, the present invention can be used to load standard sized pallets, since there is no interference between the chain hoist and the wrap ring.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An apparatus for packing and wrapping a load containing a number of bundles, said apparatus comprising:

conveyor means for receiving said bundles;

positioning means located downstream of said conveyor means for arranging said bundles into layers;

plate means adjacent said positioning means for receiving and discharging said layers;

a first lift means;

a second lift means mounted on said first lift means, said second lift means including structure for raising and lowering a pallet relative to said first lift means, said first and second lift means operative to position a pallet to receive successive layers from said plate means; and a wrapping means located below said plate means, said wrapping means operative to dispense a wrapping material about said layers.

2. The apparatus of claim 1 wherein said second lift means raises said pallet and layers above said first lift means and positions said layers adjacent to said wrapping means.

3. The apparatus of claim 2 wherein said wrapping means includes a ring and a stretch wrap dispenser which is supported so as to orbit about said layers.

4. The apparatus of claim 3 wherein said layers are positioned within said ring as said stretch material is dispensed.

5. The apparatus of claim 4 further comprising means for stabilizing said layers above said wrapping means.

6. The apparatus of claim 5 wherein said stabilizing means includes guide means disposed about the perimeter of said plate means.

7. The apparatus of claim 6 wherein said guide means are formed of transparent plastic.

8. The apparatus of claim 4 wherein said second lift means vertically adjusts said layers within said wrapping means to dispense said stretch material in diagonal paths about said layers.

9. The apparatus of claim 6 wherein said first and second lift means operate concurrently to raise and lower said layers.

10. The apparatus of claim 9 wherein said second lift means is a scissor lift.

11. An apparatus for packing and wrapping a load containing a number of bundles, said apparatus comprising.

conveyor means for receiving said bundles:

positioning means, located downstream of said conveyor means for arranging said bundles into layers;

plate means adjacent said positioning means for receiving and discharging said layers;

a chain-driven hoist:

a scissor lift mounted on said hoist for raising said pallet and layers above said hoist and positioning said layers adjacent to said wrapping means, said hoist and scissor lift operating concurrently to raise and lower said layers;

a wrapping means located below said plate means, said wrapping means including a ring and a stretch wrap dispenser which is supported so as to orbit about said layers, said wrapping means operating to dispense a stretch material about said layers, said layers being positioned within said ring as said stretch material is dispensed; and guide means disposed about the perimeter of said plate means for stabilizing said layers above said wrapping means.

12. The apparatus of claim 11 wherein said hoist and said scissor lift combine to shift said pallet and preceding load layers between said plate means and said wrapping means for each layer of said load.

13. A method for palletizing and wrapping a load containing a number of bundles, said method comprising the steps of:

feeding a plurality of said bundles onto a conveyor;

arranging said bundles into a load layer on said conveyor by means of positioning structure associated with said conveyor;

transferring said load layer onto a stripper plate associated with said conveyor;

raising a pallet with a hoist located beneath said stripper plate;

raising said pallet above said hoist to said stripper plate by means of a scissor lift mounted on said hoist;

dropping said load layer from said stripper plate to said pallet;

dispensing a wrapping material about the perimeter of said load layer; and lowering said pallet.

14. The method of claim 13 further comprising the step of stabilizing said load layer after said load layer is dropped onto said pallet.

15. The method of claim 14 wherein said step of stabilizing said load layer includes passing said load layer through a plurality of guide plates.

16. The method of claim 13 further comprising the step of vertically adjusting said pallet and load as said stretch wrap is dispensed to form diagonal paths about said load.

17. The method of claim 15 wherein said material is dispensed after said load layer drops below said guide plates.

18. The method of claim 17 wherein said pallet and load layer are raised, with said scissor lift, to said stripper plate to receive another load layer.

19. The method of claim 18 further comprising the step of lowering said pallet to the bottom of said hoist after all load layers are dropped onto said pallet.

* * * * *